United States Patent [19]

Pupp et al.

[11] 4,113,101

[45] Sep. 12, 1978

[54] OPENING ARRANGEMENT FOR PACKING CONTAINERS

[75] Inventors: Herwig Pupp; Otto Birger Andersson, both of Lund

[73] Assignee: AB Ziristor, Lund

[21] Appl. No.: 777,940

[22] Filed: Mar. 15, 1977

Related U.S. Application Data

[63] Continuation-in-part of Ser. No. 720,516, Sep. 3, 1976.

[51] Int. Cl.[2] ..... B65D 17/02

[52] U.S. Cl. ..... 206/606; 206/612; 206/628; 206/631; 229/4.5

[58] Field of Search ..... 229/51 S, 51 BP, 51 AS, 229/51 DB, 51 ST

[56] References Cited

U.S. PATENT DOCUMENTS

| | | | |
|---|---|---|---|
| T626,787 | 3/1969 | Brunson et al. | 206/606 |
| 2,811,455 | 10/1957 | Erekson | 206/606 X |
| 2,909,312 | 10/1959 | Conerty | 206/606 |
| 3,195,799 | 7/1965 | Denemberg | 206/616 |
| 3,300,118 | 1/1967 | Owens | 206/606 |

*Primary Examiner*—Davis T. Moorhead

*Attorney, Agent, or Firm*—Burns, Doane, Swecker & Mathis

[57] ABSTRACT

A packing container of substantially cylindrical form is made from a convoluted blank with the end portions thereof sealed together. One end of the upper edge of the blank has a tab member extending circumferentially of the cylindrical container and the other end of the upper edge of the blank has a corresponding cut-out portion. The ends are overlapped, with the tab portion on the outside, to such an extent that the width of the seal is greater than the circumferential length of the cut-out portion so that the seal includes a finger-like extension up to the top of the container. A tear thread is attached around the inside of the container and extends along the outer tab portion so that when pulled it will tear through the finger-like seal thus facilitating opening of the container.

4 Claims, 3 Drawing Figures

OPENING ARRANGEMENT FOR PACKING CONTAINERS

This application is a continuation-inpart of our application Ser. No. 720.516 filed Sept. 3, 1976

The present invention relates to an opening arrangement for packing containers of the type which comprises a body produced by a convoluted winding of a material sheet with an overlap joint uniting the ends of the material sheet, which opening arrangement has the form of a tearing thread associated with the material sheet, which extends around the body.

It is known that packing containers for liquid contents can be made by convoluted winding of a material sheet or a part cut off a striplike web. By a suitable adaptation of the length of the material sheet, its two ends will overlap one another after the convoluted winding, and by joining together these two overlapping ends in a suitable manner into an overlap joint a tubular cylindrical packing container body is obtained. After sealing up the one end of the tubular body with or without the help of a separate end part the packing container is ready for being filled with the desired contents. Subsequently the packing container is closed with the help of either an end piece or any kind of suitable lid. To make possible a simple opening of the packing container, when the contents are to be emptied out or consumed, the lid can be provided with any kind of appropriate opening arrangement, e.g. a pouring opening covered by a tear-off strip. When the packing container is to be used for contents of high viscosity, e.g. yogurt, it is desirable for the whole lid or upper end of the packing container to be taken off so that the contents become accessible for a spoon. Opening arrangements which bring about the taking off of the lid or whole upper end part of the packing container are known, and a very appropriate such has proved to consist of a tearing thread which runs around the body of the packing container at some distance below the seal between the upper end of the tubular body and the lid. The tearing thread is located on the side of the packing container wall facing the inside of the packing container or it is embedded in a layer of thermoplastic material applied to the inside of the packing container. When the packing container is to be opened the accessible end of the tearing thread, that is to say the end which is situated in the outer material layer of the overlap joint, is gripped and is pulled round the upper part of the package, whereby it will cut through the packing container material, so that the lid and the part of the container body situated above the cut can be removed.

One difficulty with this opening arrangement is that it may be difficult to seize hold of the leading end of the tearing thread, since this cannot be made to project from the edge of the material sheet, which is connected with the fact mentioned earlier, that the material sheet from which the tubular packing container body is formed, is cut out of a larger sheet or a weblike strip which has been provided with the tearing thread already an earlier stage of manufacture. Thus the length of tearing thread present on each material sheet is cut off at the same time with the cutting off of the material sheet, which makes it impossible e.g. to shift the thread in such a manner that it might extend beyond the edge of the material sheet.

A further disadvantage with this known opening arrangement is noted when, after seizing hold of the leading end of the tearing thread, one commences to pull at the same with the intention of causing the thread to cut through the material and make possible a separation of the upper part of the packing container and the packing container body, the tearing thread will commence to cut through the packing material just at the overlap joint extending vertically over the tubular body, which renders difficult the start of the tearing, and in certain cases gives rise to the overlap joint being damaged or the tearing not taking place in the desired direction.

The abovementioned difficulties have been overcome in accordance with the present invention in that the end of the tearing thread is fixed to a tab projecting from the edge of the material sheet whilst the seal of the overlap joint is weakened just at the point where the tearing thread and the overlap joint cross one another. In detail the said problem has been solved in accordance with the invention in that an opening arrangement for packing containers of the type which comprises a body produced by convoluted winding of a material sheet with an overlap joint combining the ends of the material sheet, which opening arrangement has the form of a tearing thread associated with the material sheet which extends around the body, has been given the characteristic that the one end of the tearing thread extends in a manner known in itself into a tab which is attached to the outer one of the two sheet ends forming the overlap joint, and that the inner one of the two sheet ends forming the overlap joint is provided at a level with the tab with a cutout situated in the lower material layer of the overlap joint, whose dimension corresponding to the width of the overlap joint is smaller than the width of the overlap joint.

A preferred embodiment of the arrangement in accordance with the invention has been given the further characteristic that the cutout has a dimension corresponding to the width of the overlap joint which amounts to between $\frac{3}{4}$ and 4/5 of the width of the overlap joint.

Further preferred embodiments of the arrangement in accordance with the invention have been given the further characteristic that the packing container is manufactured from a laminated material comprising a central layer of foamed plastic material with external layers of homogeneous thermoplastics.

It is a further characteristic of the opening arrangement in accordance with the invention that it is situated in the abovementioned type of packing container in the thermoplastic layer facing towards the inside of the container.

In a further preferred embodiment of the invention the overlap joint is produced by heat sealing.

To facilitate the gripping of the tab, which in certain cases can lie closely to the container body and can thus be difficult to seize hold of, finally a further preferred embodiment of the opening arrangement in accordance with the invention has been given the characteristic that the tab is manufactured in one piece with the sheet material and is adapted so that by a heating carried out after the container body has been formed it is given a form so that it projects from the periphery of the container.

In the following a preferred embodiment of the opening arrangement in accordance with the invention will be described in greater detail with reference to the enclosed schematic drawing.

Figure 2:
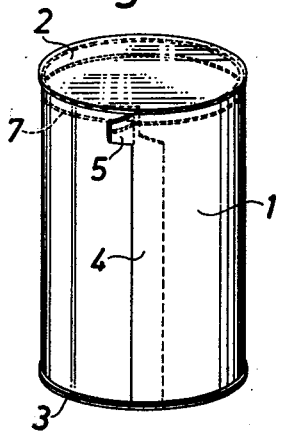
FIG. 2 shows a packing container with an opening arrangement according to the invention.

A packing container with an opening arrangement according to the present invention is shown in FIG. 2 and comprises a tubular, circular container body 1 and two end pieces 2, 3 connected to the same in a liquid-tight manner. The container body 1 is manufactured by convoluted winding of a material sheet and possesses a joint 4 uniting the two overlapping ends of the material sheet. At the upper end of the overlap joint 4 is a tab 5.

Figure 1:
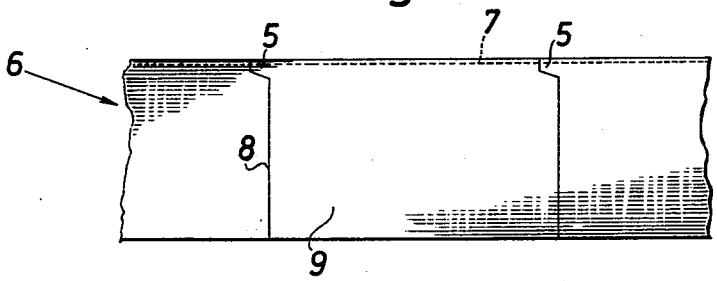
FIG. 1 shows a material strip for the manufacture of packing containers with opening arrangement according to the invention.

The body of the packing container or shell surface 1 is manufactured from a laminated material which comprises a central layer of foamed plastic material which is coated on both sides with a homogeneous layer of themoplastic material. The laminated material is passed to a machine manufacturing packing containers in the form of a web 6 (FIG. 1), which in an earlier stage has been provided with a tearing thread 7. The tearing thread 7 is embedded in the homogeneous thermoplastic layer which afterwards in the finished packing container is facing inwards. When the material strip is fed into the packing machine it is cut up by repeated transverse cuttings 8 into material sheets 9 which subsequently are transformed to the container body or shell surface 1. The cutting lines 8 are in their greater length straight lines, but at their one end situated close to the edge of the material web 6 they are displaced in a step-like manner in the longitudinal direction of the material web 6. As a result each material sheet 9 will be provided at its one end with a corresponding cutout, whose shape and placing correspond to the shape and placing of the tab 5 in the following material sheet. The tab 5 (and consequently also the cutout) is situated at the edge of the material web 6 at which is also situated the tearing thread 7 and the tearing thread thus extends into the tab 5 and will be cut off consequently somewhat beyond the main part of the cutting line 8 when the web is being divided into individual sheet blanks 9.

After the separation of a material sheet 9 from the material web 6, the sheet is wound by convoluted winding around a mandrel to a cylinder of the desired diameter. The length of the sheet 9 is chosen in such a manner that it slightly exceeds the circumference of the mandrel, as a result of which the end of the material sheet 9 provided with the tab 5, after the convoluted winding, will overlap the opposite end of the sheet 9. By heating the thermoplastic layers facing one another in the overlap region and subsequently pressing together the end parts along a sealing zone extending vertically over the container body 1, the sleevelike container body is produced. Then the container body is provided with the bottom end piece 3, and after filling with the intended contents an upper part or lid 2 is also applied, whereupon the packing container is finished.

Figure 3:
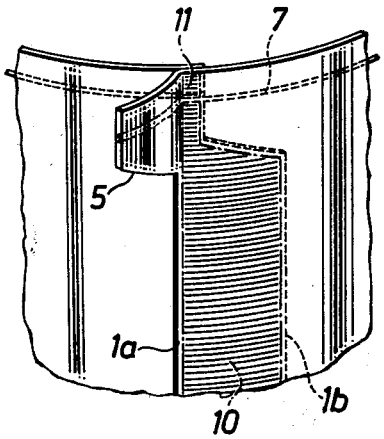
FIG. 3 shows on an enlarged scale a part of a packing container with an opening arrangement according to the invention.

The upper part of the shell surface 1 of the packing container in which the tab 5 is located, is shown on a larger scale in FIG. 3. In the figure the tearing thread 7 situated on the remote side of the shell surface 1 is shown by means of a dash-dotted line. It is also evident how the two end parts 1*a* and 1*b* of the shell surface 1 overlap one another and form the over-lap joint 4 indicated in FIG. 2. Within the greater part of the surface of the overlap joint 4 the two material ends 1*a* and 1*b* are sealed to each other, which is indicated in FIG. 3 by means of a lined sealing zone 10. The seal between the material ends 1*a* and 1*b* is brought about by warming up the material ends to the softening temperature of the thermoplastic material, whereupon they are pressed together by means of a sealing element in the form of a compression finger or a compression roller moving along the length of the overlap joint. The sealing zone 10 is substantially of uniform width over the greater part of the length of the overlap joint 4, but at the upper end of the joint the sealing zone 10 will diminish owing to the cutout in the material 1*a* mentioned earlier, so that it only extends in the form of a narrow sealing finger 11 to the upper edge of the shell surface 1. The width of this sealing finger 11 is independent of the width of the compression element which is used for producing the sealing zone and is connected only on the one hand with the width of the overlap joint and on the other hand with the dimension of the cutout corresponding to the width of the overlap joint. It has been found that the sealing finger 11 obtains a suitable width if the dimension of the cutout corresponding to the width of the overlap joint amounts to between $\frac{3}{4}$ and 4/5 of the total width of the overlap joint. The width of the sealing finger 11 is then such that the tightness of the packing container is assured, whilst the sealing finger 11 does not appreciably hinder the opening of the packing container with the help of the tearing thread 7 which easily breaks through the sealing finger 11.

The special shaping in accordance with the invention of the tab 5 and the corresponding cutout in the other end of the material sheet 9 has proved to be very appropriate when a number of material sheets 9 are manufactured in the form of a material web 6 or in the form of a larger sheet, since material waste is completely avoided. Moreover, the fact that the special shape of the tab and of the cutout allows the sealing of the overlap joint with the help of a compression element of uniform width has proved to be very advantageous when a number of shell blanks 1 in succession is formed on a long mandrel, whereupon the sealing of the overlap joints 4 takes place in succession with the help of a roller running along the mandrel. The sealing zone 10 will then be given on each container body 1 the desired form with the projecting sealing finger 11 without having to take into account in any way the length of the container body 1 or the axial position on the mandrel.

A preferred embodiment of the packing container in accordance with the invention is manufactured from a laminated material which comprises a central layer of foamed plastic with outer layers of homogeneous thermoplastics. In this type of packing material the sealing of the overlap joint 4 can take place simply, after the convoluted winding of the material sheet 9 on the mandrel, by blowing hot air into the pocket between the ends 1*a* and 1*b* of the material sheet, so that the thermoplastic layers facing one another are heated up to their softening temperature, whereupon the pressing together takes place in the manner described earlier. For a further facilitating of the opening of the packing it is appropriate to see to it at the same time that the projecting tab 5 is subjected to the jet of hot air and is heated to softening temperature. This will cause the foamed plastic material in the tab to shrink together, so that the tab becomes more compact and rigid and is induced no longer to follow the outer contour of the packing container but to extend at an angle outwards from the shell surface. This considerably facilitates the gripping of the tab 5 when the packing container is to be opened.

As is evident from the description, a reliable opening arrangement is provided in accordance with the invention in a simple and economical manner which is simple to use and which nevertheless assures a tight package.

We claim:

1. A packing container provided with an opening arrangement comprising a substantially cylindrical body member formed from a convoluted blank with overlapping sealed end portions, said body member being closed at the top and bottom thereof and comprised of a carton forming material having a base layer and at least one layer of thermoplastic material disposed on the inside of the body member, a tear thread disposed circumferentially on said thermoplastic layer on the inside of the body member adjacent to and spaced from the top thereof, the outer of said overlapped sealed end portions being provided, at the top thereof, with a circumferentially extending tab member having the tear thread passing circumferentially therealong, and the inner of said overlapped sealed end portions having a cut-out portion at the top thereof corresponding in size and shape with the tab member, the circumferential dimension of the cut-out portion being about $\frac{3}{4}$ to 4/5 of the width of the overlapping seal below said cut-out portion to provide an upper, vertically extending, narrow finger-like seal between the outer of said end portions adjacent said tab member and the inner of said end portions adjacent the cut-out portion, whereby opening the packing container may be facilitated by pulling the tab member and associated tear thread to tear through the narrow finger-like seal and cylindrical body members.

2. A packing container as claimed in claim 1 wherein the base layer of the carton forming material comprises a foamed plastic material and the at least one thermoplastic layer comprises a homogeneous thermoplastic material.

3. A packing container as claimed in claim 1 wherein said tab member is integral with said body member.

4. A packing container as claimed in claim 2 wherein said tab member is integral with said body member and said tab member is compact and rigid and is directed outwardly from the circumference of the packing container to facilitate gripping of the tab member for opening said container.

* * * * *

UNITED STATES PATENT AND TRADEMARK OFFICE

CERTIFICATE OF CORRECTION

PATENT NO. : 4,113,101

DATED : September 12, 1978

INVENTOR(S) : Herwig Pupp and Otto Birger Andersson

It is certified that error appears in the above-identified patent and that said Letters Patent are hereby corrected as shown below:

Insert the following Foreign Application Priority Data at the appropriate place in the patent document:

| | | |
|---|---|---|
| -- Sep. 10, 1975 | Sweden | 75100925 |
| Dec. 3, 1976 | Sweden | 7613584 -- |

Signed and Sealed this

*First* Day of *May 1979*

[SEAL]

*Attest:*

RUTH C. MASON
*Attesting Officer*

DONALD W. BANNER
*Commissioner of Patents and Trademarks*